US005585052A

United States Patent [19]

Chau et al.

[11] Patent Number: 5,585,052

[45] Date of Patent: Dec. 17, 1996

[54] PROCESS FOR THE PREPARATION OF POLYBENZAZOLE STAPLE FIBER

[75] Inventors: Chieh-Chun Chau; Ritchie A. Wessling, both of Midland, Mich.; Katsuya Tani, Shiga-gun, Japan; Masaru Nakagawa, Tsuruga, Japan; Takaharu Ichiryu, Ohtsu, Japan

[73] Assignee: The Dow Chemical Company, Midland, Mich.

[21] Appl. No.: 365,614

[22] Filed: Dec. 28, 1994

[51] Int. Cl.[6] ..... D01D 5/26; D01D 10/06; D01F 6/74

[52] U.S. Cl. ..... 264/28; 264/143; 264/211.15; 264/211.16; 264/233

[58] Field of Search ..... 264/28, 143, 184, 264/211.14, 211.15, 211.16, 233

[56] References Cited

U.S. PATENT DOCUMENTS

| | | | |
|---|---|---|---|
| 4,963,298 | 10/1990 | Allen et al. . | |
| 5,163,348 | 11/1990 | Kitada et al. . | |
| 5,164,131 | 11/1992 | Chau et al. | 264/28 |
| 5,273,703 | 12/1993 | Alexander et al. | 264/184 |

*Primary Examiner*—Leo B. Tentoni

[57] ABSTRACT

The invention is a process for the preparation of polybenzazole staple fibers which includes extruding a solution of polybenzazole polymer to form a dope filament, cutting the dope filament to a desired length, and washing and drying the cut filament. It has been discovered that the process of the invention provides a suitable means to prepare staple fibers which does not require the cutting of washed, rigid polybenzazole filaments.

11 Claims, 2 Drawing Sheets

PROCESS FOR THE PREPARATION OF POLYBENZAZOLE STAPLE FIBER

BACKGROUND OF THE INVENTION

This invention relates to a process for the preparation of staple fibers with high strength and high tensile modulus. More specifically, this invention relates to a process for the preparation of polybenzazole staple fibers.

Staple fibers are short, random fibers or filaments which are typically prepared by cutting a dried fiber or filament into short lengths. Such fibers are particularly useful in composite applications. It is known to prepare filaments and fibers of polybenzazole polymers by extrusion of a solution of the polymer, followed by drawing, washing, and drying of the extrudates. It is also known to prepare short polybenzazole fibers by cutting the filament after it has been washed and while it is still wet, as described in U.S. Pat. No. 5,164,131. However, filaments which have been thoroughly washed are rigid and difficult to cut while traveling at a high line speed. Accordingly, it would be desirable to develop an improved process for the preparation of cut fibers.

SUMMARY OF THE INVENTION

In one aspect, this invention is a process for the preparation of polybenzazole staple fibers which comprises extruding a solution of polybenzazole polymer to form a dope filament, cutting the dope filament to a desired length, and washing and drying the cut filament. It has been discovered that the process of the invention provides a means to prepare staple fibers which does not require the cutting of washed, rigid polybenzazole filaments. These and other advantages of the invention will be apparent from the description which follows.

DESCRIPTION OF THE DRAWINGS

Understanding of the invention will be facilitated by referring to the accompanying drawings in FIG. 1, which is a schematic representation of one embodiment of the process of the invention.

DETAILED DESCRIPTION OF THE INVENTION

Figure 1:
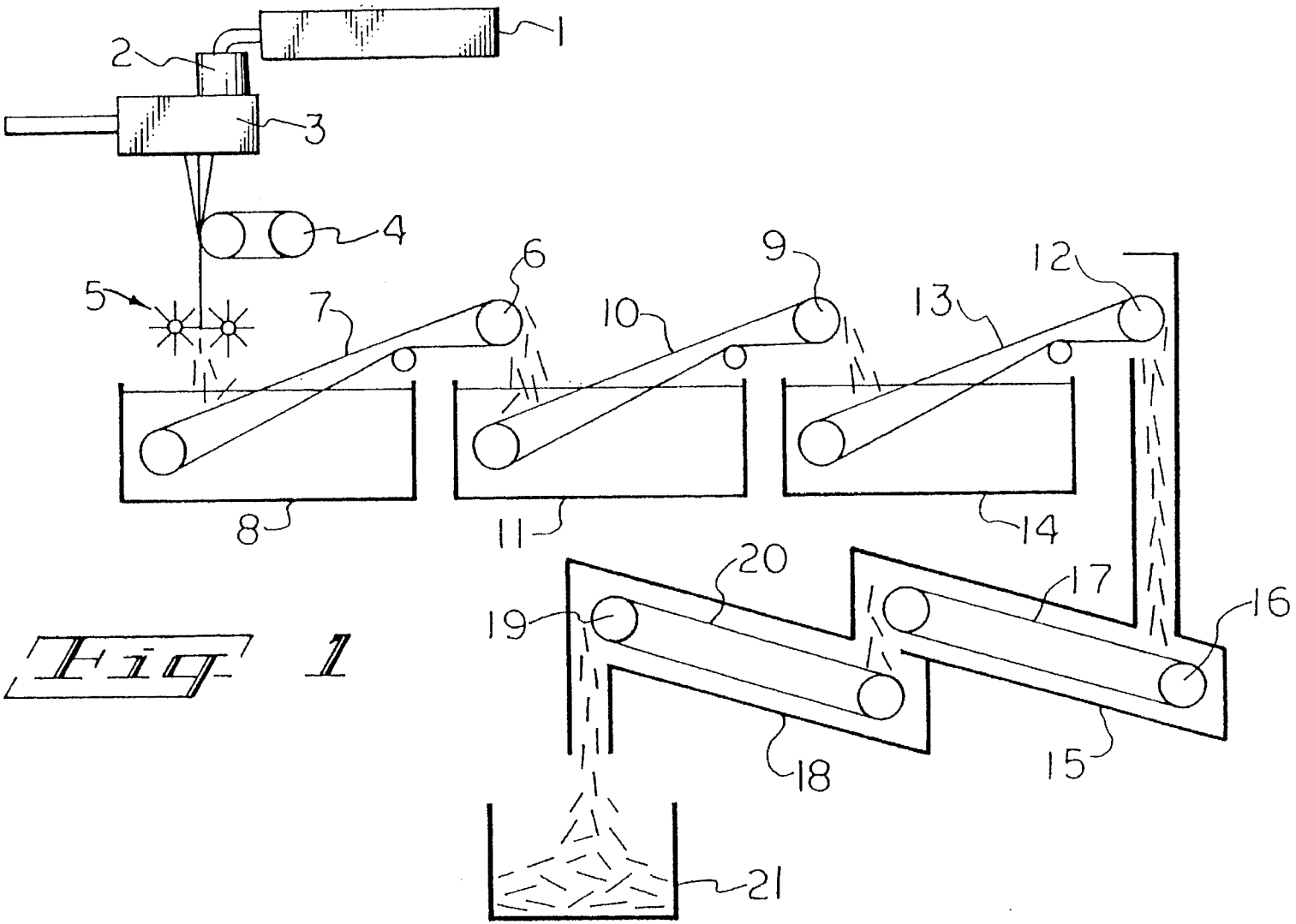
Figure 2:
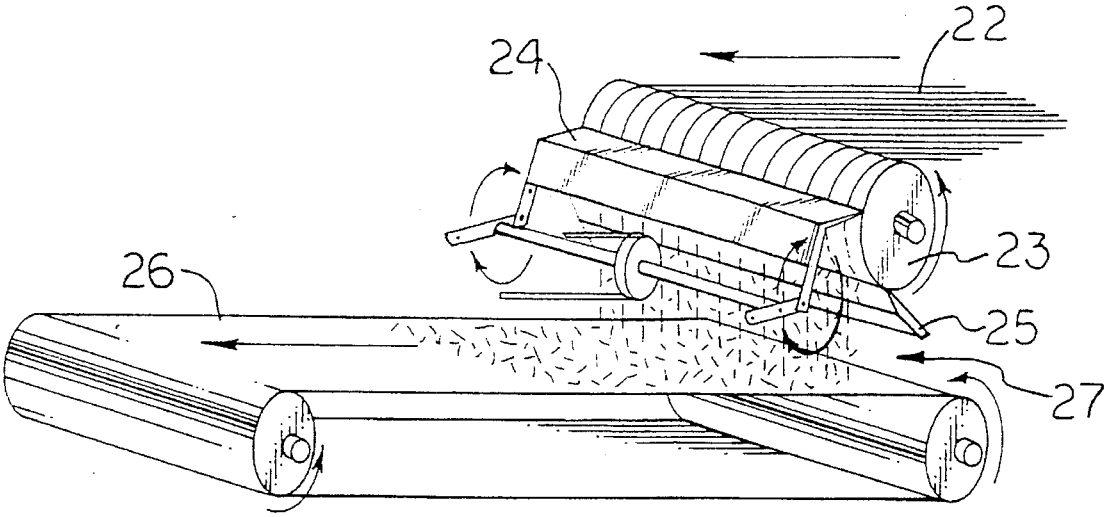
FIGS. 2 and 3, which illustrate cutting devices useful in the process of the invention.
Figure 3:
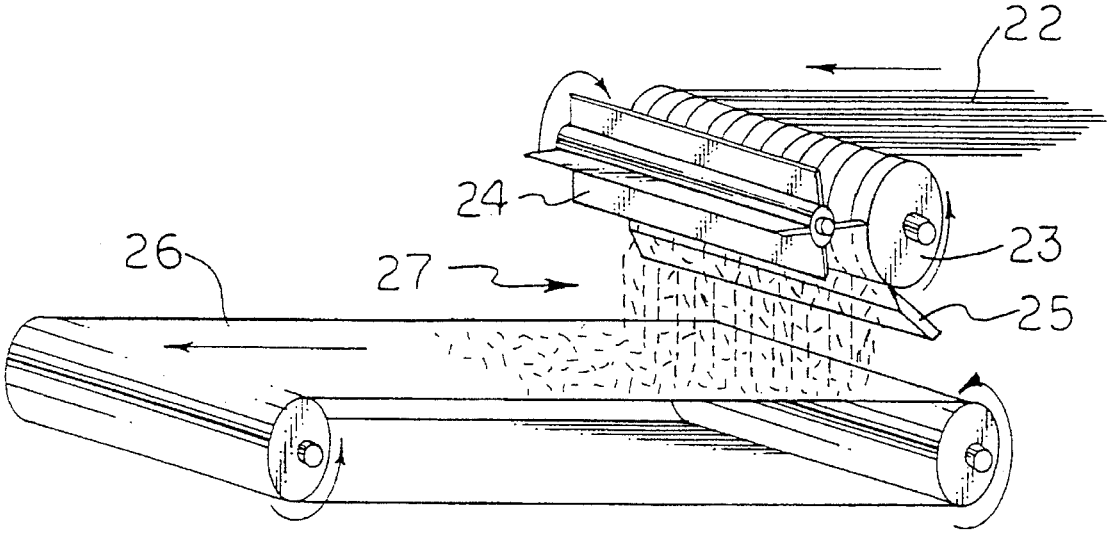

Referring now to FIGS. 1, 2, and 3, FIG. 1 illustrates one embodiment of the process of this invention. A solution of polybenzazole polymer in polyphosphoric acid ("dope") is supplied to a spinning head (2) through an extruder (1). The dope is preferably passed through one or more filters and/or porous plates inside the spinning head and is subsequently spun through a spinneret (not illustrated) on which several orifices are arranged in a circular or lattice pattern. The temperature of spinneret surface should be as uniform as possible.

The dope filaments spun from the spinneret are passed through a quench chamber (3) located below the spinneret, and the running speed of the dope filaments is regulated by the dry rollers (4) located after the quench chamber, which draw the fiber through the quench chamber and across the air gap between the quench chamber and the rollers. The quench chamber and the air gap may contain any fluid that does not remove the acid solvent or react adversely with the dope, such as air, nitrogen, argon, helium or carbon dioxide. The dope filaments are subsequently introduced into a cutting device (5) to cut them into desired lengths. Any suitable cutting device may be used, including conventional cutting devices such as reciprocal cutters and rotary cutters. FIGS. 2 and 3 illustrate examples of cutting devices. In FIGS. 2 and 3, a continuous dope filament bundle fixed to the surface of a drum (23) located after the rollers (4) is cut using a cutter blade (24). FIG. 2 illustrates a reciprocal type cutter, and FIG. 3 illustrates a rotary cutter. The cut dope filaments (27) are allowed to fall as they are scraped off the drum with a scraper (25). Alternatively, the dope filaments may be frozen to a temperature at which they become brittle and then cut with a conventional cutting device as described above, or cut with a grinding device. Preferably, the frozen filaments are cut or ground at a temperature below about 5° C., more preferably below about 0° C. In yet another embodiment, the dope filaments may be cut with a high pressure water stream.

If a reciprocal cutter device or rotary cutter device is used, the drum, cutter blade, and scraper are preferably made of a material which is resistant to corrosion by the acid solvent. In addition, it is important that the cutter blade maintain sharpness and not be damaged. The drum surface is preferably constructed from stainless steel number SS316, and the cutter blade is preferably constructed of stainless steel number SS431. It is desirable to coat the surface of scraper with poly(tetrafluoroethylene) to reduce the friction and wear on the part. The length of the cut dope filaments is preferably at least about 0.1 mm, more preferably at least about 1 mm, but is preferably no greater than about 100 mm, more preferably no greater than about 60 mm.

In the process of the invention, the dope filaments are cut into the desired length after they are spun from the spinneret but before they are washed with a fluid which is a non-solvent for the polybenzazole polymer but which will dissolve and wash the acid solvent out of the dope ("washing fluid"). However, the filaments may be brought into contact with minor amount of such fluid, such as by exposing the filament to a spray of water mist or water vapor, for example, without departing from the invention. In such cases, the solvent content of the filament should not be reduced below about 1 percent. If the filaments are to be frozen to a temperature below about 5° C., the solvent content of the filament should not be reduced below about 40 percent, prior to freezing and cutting or grinding. However, the filaments are preferably not contacted with any moisture prior to being cut, except for atmospheric moisture present due to the humidity of the spinning environment. The filaments are then contacted with a washing fluid to extract at least a portion of the acid solvent therefrom. If the acid solvent contains phosphorous, the filaments are preferably washed to a residual phosphorous content of less than about 8,000 ppm, more preferably less than about 5,000 ppm.

FIG. 1 shows an outline of a device which may be used to collect and transfer the cut polybenzazole fibers using a net conveyer. A washing fluid may be sprayed onto the cut dope filaments in one step or more steps, and the filaments are then dried. Examples of suitable washing fluids include water and mixtures of water and the solvent from which the dope is prepared, such as polyphosphoric acid.

The dope filaments cut to a desired length in the manner described above may be collected on a conveyer belt (7) in a first washing bath (8) or may be collected on the conveyer (7) prior to the first washing bath and subsequently transferred thereto. Preferably, at least 99.0 percent by weight, more preferably at least 99.5 percent by weight of the solvent acid present in the fiber is extracted in the washing baths.

In order to economically and efficiently reduce the acid solvent contained in the staple fiber in a short time, several washings baths arranged in series (8, 11, and 14) may be used, as illustrated in FIG. 1, although solvent removal may be carried out as a single operation in one washing bath as well. If a series of washing baths are used, the acid solvent concentration in the individual washing baths is preferably progressively lower from the first extraction bath to the second extraction bath, until the staple fiber is finally washed in a medium which has a low concentration of the acid solvent. It is desirable to treat the fiber in an alkaline medium with pH of 8 to 12 before the final extraction bath in order to prevent deterioration of physical properties of the fiber during the drying step. Preferably, the washing fluid is water or methanol, or mixtures of such fluids and the solvent acid, or super heated steam or saturated steam. The temperature of the washing fluid is preferably in the range of from about 5° C. to about 100° C. If desired, a lubricating finishing oil may then be applied to the staple fiber.

The fiber is then dried to a low residual moisture content. An important factor in staple fiber drying is to select the drying temperature so that the fiber may be dried as quickly as possible while minimizing the formation of voids therein, described U.S. Pat. No. 5,429,787, entitled "Method For Rapid Drying of a Polybenzazole Fiber". A single drying device or multiple drying devices may be used to dry the fiber, but preferably two or more devices are used. An example is illustrated in FIG. 1. A series of two or more drying devices (15 and 18) equipped with a driving device (16 and 19) and a net conveyer (17 and 20) may be used, and the temperature inside the second drying device is preferably higher than that of the first drying device.

The fiber is preferably dried to a moisture content of less than 3.0 percent by weight, more preferably less than 2.0 percent by weight, more preferably less than 1.0 percent by weight, and most preferably less than 0.5 percent by weight. The temperature of the first drying device is preferably at least 130° C., more preferably at least about 150° C., and most preferably at least about 160° C.; but is preferably no greater than about 230° C., more preferably no greater than about 220° C., and is most preferably no greater than about 210° C. The appropriate temperature for the drying devices varies according to the moisture content of the staple fiber introduced to the individual drying device, but preferably does not exceed 250° C. The staple fiber may be heated by any suitable means, such as by hot air circulation or infrared heating. The atmosphere inside the drying device may be, for example, nitrogen, argon, or air. The staple fiber dried to a desired moisture content in this manner may then be shaken off to a storage bin (21).

The polybenzazole filaments used in the process of the invention may be obtained by spinning a dope containing a polybenzazole polymer. As used herein, "polybenzazole" refers to polybenzoxazole (PBO) homopolymers, polybenzothiazole (PBT) homopolymers, and random, sequential or block copolymerized polymer of PBO and PBT. Polybenzoxazole, polybenzothiazole, and random, sequential, or block copolymerized polymers thereof are described, for example, in "Liquid Crystalline Polymer Compositions, Process and Products" by Wolfe et. al, U.S. Pat. No. 4,703,103 (Oct. 27, 1987); "Liquid Crystalline Polymer Compositions, Process and Products" U.S. Pat. No. 4,533,692 (Aug. 6, 1985); "Liquid Crystalline Poly(2,6-benzothiazole) Composition, Process and Products" U.S. Pat. No. 4,533,724 (Aug. 6, 1985); "Liquid Crystalline Polymer Compositions, Process and Products" U.S. Pat. No. 4,533,693 (Aug. 6, 1985); "Thermooxidatively Stable Articulated p-Benzobisoxazole and p-Benzobisthiazole Polymers" by Evers, U.S. Pat. No. 4,539,567 (Nov. 16, 1982); and "Method for Making Heterocyclic Block Copolymer" by Tsai, U.S. Pat. No. 4,578,432 (Mar. 25, 1986).

The structural units present in PBZ polymer are preferably selected so that the polymer is lyotropic liquid crystalline. Preferred monomer units are illustrated below in Figures I–VIII. The polymer more preferably consists essentially of monomer units selected from those illustrated below, and most preferably consists essentially of cis-polybenzoxazole, trans-polybenzoxazole, or trans-polybenzothiazole.

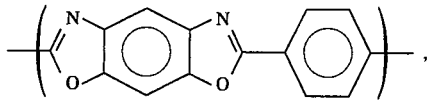

I cis-polybenzoxazole
Poly[benzo(1,2-d:5,4-d')bisoxazole-2,6-diyl-1,4-phenylene]

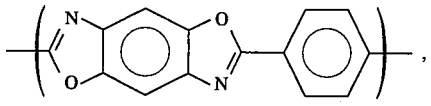

II trans-polybenzoxazole
Poly[benzo(1,2-d:4,5-d')bisoxazole-2,6-diyl-1,4-phenylene]

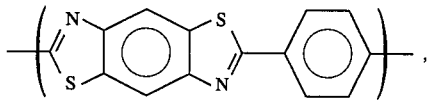

III trans-polybenzothiazole

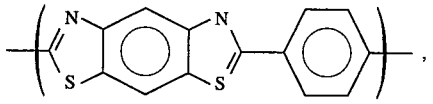

IV cis-polybenzothiazole

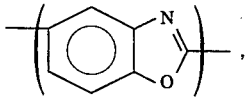

V

AB-PBO
Poly (2,5-benzoxazole)

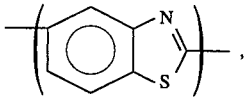

VI

Poly (2,5-benzothiazole)

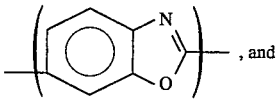

, and

VII

AB-PBO
Poly (2,6-benzoxazole)

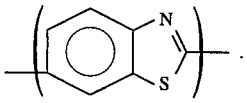

VIII

Poly (2,6-benzothiazole)

Suitable polybenzazole polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); Harris, U.S. Pat. No. 4,847,350 (Jul. 11, 1989); and Gregory et al., U.S. Pat. No. 5,089,591 (Feb. 18, 1992), which are incorporated herein by reference. In summary, suitable monomers are reacted in a solution of nonoxidizing and dehydrating acid (the acid solvent) under nonoxidizing atmosphere with vigorous mixing and high shear at a temperature that is increased in step-wise or ramped fashion from no more than about 120° C. to at least about 190° C. Suitable solvents for the preparation of PBZ polymer dope include cresols and non-oxidizing acids. Examples of suitable acid solvents include polyphosphoric acid, methane sulfonic acid, and highly concentrated sulfuric acid or mixtures thereof. Preferably, the solvent acid is polyphosphoric acid or methane sulfonic acid, but is most preferably polyphosphoric acid.

The polymer concentration in the solvent is preferably at least about 7 percent by weight, more preferably at least 10 percent by weight, and most preferably at least 13 percent by weight. The maximum concentration is limited by the practical factors of handling, such as polymer solubility and dope viscosity. The polymer concentration normally does not exceed 30 percent by weight, and is preferably no greater than about 20 percent by weight. Oxidation inhibitors, deglossing agents, coloring agents, and anti-static agents may also be added to the dope.

The solutions of polybenzazole polymers may be stored for a period of time prior to spinning. However, it is particularly desirable to conduct a continuous polymerization, direct spinning method in which polymerization is conducted continuously and a spinning dope is supplied directly to a spinning device without prior storage. The process of the present invention is preferably run in a continuous fashion with a line speed of at least about 50 meters/minute (m/min). The line speed is more preferably at least about 200 m/min., more preferably at least about 400 m/min. and most preferably at least about 600 m/min.

ILLUSTRATIVE EMBODIMENTS

The following examples are given to illustrate the invention and should not be interpreted as limiting it in any way. Unless stated otherwise, all parts and percentages are given by weight.

EXAMPLE 1

A portion of 4,6-diamino-1,3-benzenedio.dihydrochloride (50.0 g, 0.235 mole) is agitated with 200 g of polyphosphoric acid (with a phosphorus pentoxide content 83.3 percent by weight) for twelve hours at 40° C. under a nitrogen blanket. The temperature of the mixture is raised to 60° C., and dehydrochlorination is conducted under reduced pressure of about 50 mm Hg. To this mixture, terephthalic acid (39.0 g, 0.236 mole) and 103 g of phosphorus pentoxide are added, and the mixture is heated under a stream of nitrogen for eight hours at 60° C., then nine hours at 120° C., then fifteen hours at 150° C., and then 28 hours at 180° C. The polybenzazole polymer solution obtained by polymerization in this manner is used as spinning dope without any further treatment. The concentration of the polymer obtained by the reaction described above is 14.0 percent by weight, and concentration of the solvent is 86.0 percent by weight ($P_2O_5$ concentration base).

The polymer dope is degassed in a twin screw extruder. The pressure is raised, and the dope is transferred to a spinning head using a metering pump. The spinning dope is extruded through a spinneret with 668 orifices, an orifice diameter of 0.22 mm, orifice length of 0.40 mm, entering angle of 20 degrees, and orifice density of 5/cm$^2$. The spinning temperature is 165° C., and the discharge rate per single orifice is 0.23 g/min. The distance between the spinneret and the quench chamber is 2 cm and the length of the quench chamber is 20 cm. The temperature of the air flow in the quench chamber is 70° C., and the air flow rate is 0.7 m/sec. The filaments are drawn by a pair of dry rollers positioned 150 cm below the spinneret face at a speed of 200 m/min. Next, the fiber filaments are led to a staple cutter (rotary cutter) located under the pair of rollers and cut into fibers 45 mm long. The cut fiber filaments are collected on a conveyer belt. The weight of the filaments is about 1.49 denier per filament.

Thereafter, the cut staple fibers are transferred into the first washing bath containing a 10 percent by weight aqueous polyphosphoric acid solution maintained at 22°±2° C. Thereafter, the filaments are conveyed through an alkaline solution bath maintained at 22°±2° C. and having pH of 10.5, and then washed in a water bath. A finishing oil is added to the staple fiber, and the fibers are passed through a first hot air circulating type oven maintained at 190° C. and a second hot air circulating type oven maintained at 220° C. to dry them until the moisture content is 0.5 percent by weight. Next, the dry staple fibers are shaken off to a storage bin. The properties of the staple fiber obtained are evaluated.

The intrinsic viscosity of the polybenzazole polymer is measured by mixing a portion of the polybenzoxazole dope with water in a household blender and activating the blender several times. The polymer powder is then re-dissolved in methane sulfonic acid, and intrinsic viscosity is measured at 30° C. The fiber size is measured using a Denicon machine (available from Vibroscope) after the fiber is left standing for 24 hours in a constant temperature constant humidity chamber maintained at temperature of 22° C. and humidity of 65 percent relative humidity.

The phosphorous content of the filaments are measured by an atomic spectroscopy technique. This phosphorus atom concentration may then be converted into phosphoric acid concentration (percent by weight). The average phosphorous content of the fibers is 3800 ppm. The tensile strength and modulus of the fibers is measured according to Japanese industrial test method number JIS L-1013 (1981) using a Tensilon machine (available from Toyo Baldwin Co.). The gauge length is 5 cm and the deformation rate is 100 percent per minute. The average tensile strength of the fibers over 50 measurements is 5.5 GPa, the elongation at break is 3.7 percent, and the tensile modulus is 159 GPa.

The moisture content of the filament is measured according to the following method: A fiber sample taken before a drying device is weighed (Wi), and the said sample is left standing for 30 minutes in a hot air circulating oven maintained at 230° C. The sample is cooled to room temperature in a desiccator, and a sample weight (Wf) is measured. Moisture content is calculated using the following equation: $RMC=(W_i-W_f)/W_f\times 100$. An optical microscope (200×) may be used to check for the presence or absence of filament damage (kink bands). There are fewer than 5 damaged filaments per 100 filaments. The presence of kink bands may reduce the tensile strength of the short fiber after exposure to sunlight. Kink bands may be observed as dark bands in the filament, which are visible under 200× magnification.

EXAMPLE 2

A fourteen weight percent solution of cis-polybenzoxazole (having an intrinsic viscosity of 30 dL/g at 25° C. and a concentration of 0.05 g/dL concentration in methane-sulfonic acid) in polyphosphoric acid is prepared. The dope is spun into filaments through a 31-hole, 3 mil spinneret at a spinning temperature of 150° C. The filaments are hand drawn and collected onto a 3¾" spool and cut into 5- to 8-inch filaments. The filaments are immersed in liquid nitrogen for at least 30 seconds and fed into a centrifugal grinder. The grinder is operated on a low speed setting with a screen size of 1.8×1.2 mm openings. Liquid nitrogen is fed into the grinding chamber before and during the grinding to keep the chamber at a low temperature. The ground filaments are then washed in water for 2 hours and air-dried for 1 hour.

What is claimed is:

1. A process for the preparation of a polybenzazole staple fiber which comprises extruding a solution of polybenzazole polymer to form a dope filament, cutting the dope filament to a desired length, and washing and drying the cut filament to form a polybenzazole staple fiber.

2. The process of claim 1 wherein the step of cutting the dope filament to a desired length is performed by using a rotary cutting device.

3. The process of claim 1 wherein the step of cutting the dope filament to a desired length is performed by using a reciprocal cutting device.

4. The process of claim 1 wherein the dope filament is frozen to a temperature of less than about 0° C. prior to cutting.

5. The process of claim 1 wherein the polybenzazole polymer is polybenzoxazole.

6. The process of claim 1 wherein the polybenzazole polymer is polybenzothiazole.

7. The process of claim 1 wherein the cut fiber is brought into contact with an aqueous alkaline solution having a pH of 8 to 12 during the washing step.

8. The process of claim 1 wherein the length of the cut filament is at least about 0.1 mm.

9. The process of claim 1 wherein the length of the cut filament is at least about 1 mm.

10. The process of claim 1 wherein the length of the cut filament is no greater than about 100 mm.

11. The process of claim 1 wherein the length of the cut filament is no greater than about 60 mm.

* * * * *